8-108.1 SR
F6966 XR 4,218,220

United States Patent [19]
Kappler et al.
[11] 4,218,220
[45] Aug. 19, 1980

[54] METHOD OF FADING BLUE JEANS

[75] Inventors: Frank R. Kappler, Wyandotte; John J. Cramer, Grosse Ile; Sarwan K. Kakar, Flat Rock, all of Mich.

[73] Assignee: BASF Wyandotte Corporation, Wyandotte, Mich.

[21] Appl. No.: 965,937

[22] Filed: Dec. 4, 1978

[51] Int. Cl.[2] ..... D06L 3/00
[52] U.S. Cl. ..... 8/102; 8/108 A
[58] Field of Search ..... 8/102, 108 A

[56] References Cited

U.S. PATENT DOCUMENTS 3,707,506 12/1972 Lozo ..... 8/139
4,116,849 9/1978 Leikhim ..... 8/108 A
4,116,851 9/1978 Rupe et al. ..... 8/108 A

*Primary Examiner*—Melvyn I. Marquis
*Attorney, Agent, or Firm*—Joseph D. Michaels

[57] ABSTRACT

Evenly pre-faded blue jeans are obtained by subjecting the blue jeans to a washing cycle comprising (a) an initial wash with detergent and emulsifier, (b) a suitable intermediate rinsing operation, (c) a bleaching operation in which the garments are subjected to the simultaneous action of bleach and a fabric softener of the quaternary ammonium type, alone or with the addition of a suitable amount of detergent, (d) a further rinsing operation, and (e) an optional final treatment with fabric softener and laundry sour.

6 Claims, No Drawings

METHOD OF FADING BLUE JEANS

BACKGROUND OF THE INVENTION

1. Field of the Invention

This invention relates to a method of pre-fading blue jeans, particularly on a commercial scale, while avoiding the development of unwanted streaks or other indications to the effect that the blue jeans have not become faded through normal wear and repeated washings.

2. Description of the Prior Art

To the best of the knowledge of the applicants, there has not been known, before the present invention, any satisfactory procedure for making commercially pre-faded blue jeans that are free of unwanted streaks. Satisfactory, unstreaked, suitably faded blue jeans have hitherto been obtained by repeated washings. Attempts have been made to produce and market blue jeans having a proper and acceptable faded look that were, in fact, new garments, but the results, in terms of avoiding the appearance of unwanted streaks, have always, according to the applicants' knowledge, been unsatisfactory.

The particular chemicals used in the practice of the present invention (detergent, emulsifier, fabric softener, bleach, and laundry sour) are each, of course, already known per se. What has not been known, in accordance with the prior art, was how, in accordance with the present invention, they could be used to achieve the commercially desirable result indicated above.

It can also be taken as known that commercially available fabric softeners are of the nature of quaternary ammonium compounds, materials which are, in effect, positively charged, i.e., they hydrolyze on the basic side. At the same time, it has been known that the bleaches are negatively charged, i.e., they hydrolyze on the acidic side. Those skilled in the art of chemistry have known that it would therefore be usual to avoid the use of any treatment in which both fabric softener and bleach are caused to be present at the same time, because the two kinds of material are to be expected to cancel each other out.

SUMMARY OF THE INVENTION

The invention concerns a method of producing evenly pre-faded, new garments of blue denim, such as blue jeans. Evenly pre-faded blue jeans are obtained by subjecting the blue jeans to a washing cycle comprising (a) an initial wash with detergent and emulsifier, (b) a suitable intermediate rinsing operation, (c) a bleaching operation in which the garments are subjected to the simultaneous action of bleach and a fabric softener of the quaternary ammonium type, alone or with the addition of a suitable amount of detergent, (d) a further rinsing operation, and (e) an optional final treatment with fabric softener and laundry sour.

DESCRIPTION OF THE PREFERRED EMBODIMENTS

The first step, in the practicing of the present invention, is an initial wash or "break" of a quantity of blue jeans to be commercially pre-faded, using approximately equal quantities of a detergent and an emulsifier. One suitable detergent is, for example, the combination of alkaline builder salts plus a suitable nonionic surfactant such as that sold by BASF Wyandotte Corporation under the designation "Plurafac B-25-5" surfactant plus "LAS acid". "LAS acid" is alkylaryl sulfonic acid, 95 percent pure, the linear (biodegradable) form.

The alkaline builder salts which are used in conjunction with the mixture of nonionic surfactant and LAS include, for example, alkali metal silicates; phosphates, including the molecular dehydrated phosphates; carbonates; borates; and alkali-metal hydroxides. Typical alkaline builder salts are sodium hydroxide, sodium orthosilicate, sodium sesquisilicate, sodium metasilicate (anhydrous and/or pentahydrate), sodium carbonate, trisodium phosphate, sodium tripolyphosphate, tetrasodium pyrophosphate, sodium hexametaphosphate, and sodium tetraborate. The material hereinbelow identified as detergent A contains soda ash, sodium metasilicate, sodium hydroxide, a fluorescent whitening agent, CMC, nonionic surfactant, and LAS acid. Those skilled in the art will be able, from what has been said, to devise other built synthetic laundry detergents that have, for the purposes of the invention, an equivalent effect.

In the break step, there is also preferably used an emulsifier, such as a material consisting essentially of (A) about 20 to 80 percent by weight of a mixture of (1) nonionic surface active agents selected from the class consisting of primary oxyalkylated aliphatic-alcohols having from about 8 to 22 carbon atoms in the aliphatic portion and from 3 to 50 oxyalkylene units in the oxyalkylene portion and (2) nonionic surface-active agents selected from the class consisting of secondary oxyalkylated aliphatic alcohols having from about 8 to 22 carbon atoms in the aliphatic portion and from about 3 to 50 oxyalkylene units in the oxyalkylene portion, said nonionic surface-active agents having a cloud point in a one percent aqueous concentration of about 140° C. to 155° C. and (B) about 80 to 20 percent by weight of kerosene. Such material is sold by BASF Wyandotte Corporation as "DILIGENT" emulsifier, and is described in U.S. Pat. No. 3,707,506. Those skilled in the art will understand, from the teachings of the above-mentioned patent, how other emulsifier compositions that have substantially similar performance, for the purposes of the present invention, could be made and used.

The performance of an initial "break" step, using materials of the kind above, is well known to those skilled in the art.

Satisfactory results can be obtained with a time of ten minutes, a low water level, and a water temperature of 180° F., although these factors can also be varied suitably, as appreciated by those skilled in the art.

As would likewise be customary, after such a first step, there are presently practiced a suitable number of rinsing steps, such as one to three two-minute rinses, with a water temperature on the order of 150° F.

For the next step in a preferred manner of practicing the invention, the step of simultaneously applying fabric softener, bleach, and optionally also a suitable quantity of detergent, there will be required appropriate materials of the three categories just mentioned.

As a fabric softener, there may be used hexadecyldimethylbenzyl ammonium chloride, an agent mentioned as useful for such purpose in U.S. Pat. No. 3,095,373.

As a bleach, good results may be obtained with the use of a blend of trichloroisocyanuric acid and sodium sulfate, said acid being present in a proportion effective to give bleaching action, although those skilled in the art will appreciate that liquid sodium hypochlorite could also be used. Another possibility is the use of dichlorodimethyl hydantoin, although this compound, sold as "HALOX" bleach, is not so efficient as the other bleach agents mentioned above.

As the detergent, there may be used a detergent as defined above.

Following this step, it is again customary to provide a number of suitable rinses, such as four rinses, each of two minutes, at temperatures such as 160°, 140°, 120°, and 100° F., respectively.

As a desirable final step, but one which may optionally be omitted, there is a final sour/soft step, wherein the jeans are treated with fabric softener and laundry sour. The fabric softener may be of the kind indicated above.

The laundry sour may be ammonium silicofluoride, as indicated in U.S. Pat. No. 3,193,505.

Thereafter, the jeans are decreased in moisture content, in a usual manner, such as in centrifugal spinning, followed by a tumbling in warm air of low humidity to dry the fabrics.

By following this procedure, there are obtained new blue jeans that are evenly pre-faded, without streaking or other evidence of artificial treatment. This result is particularly attributed to the somewhat unobvious step of using fabric softener and bleach simultaneously.

The embodiments of the invention in which an exclusive property or privilege is claimed are defined as follows:

1. Method of producing evenly prefaded, new garments of blue denim, said method comprising the steps of initially washing said garments with detergent and emulsifier, bleaching the garments by subjecting them to the simultaneous action of bleach and a fabric softener of the quaternary ammonium type, and further rinsing said garments.

2. A method as defined in claim 1, wherein said bleach is a blend of trichloroisocyanuric acid and sodium sulfate, said acid being present in a proportion effective to give bleaching action.

3. A method as defined in claim 2, wherein said fabric softener is hexadecyldimethylbenzyl ammonium chloride.

4. A method as defined in claim 1, wherein said bleach is liquid sodium hypochlorite.

5. A method as defined in claim 4, wherein said fabric softener is hexadecyldimethylbenzyl ammonium chloride.

6. A method as defined in claim 1, wherein said fabric softener is hexadecyldimethylbenzyl ammonium chloride.

* * * * *